US010160007B1

(12) United States Patent
Liu et al.

(10) Patent No.: US 10,160,007 B1
(45) Date of Patent: Dec. 25, 2018

(54) ALUMINUM ALLOY HUB SURFACE TREATMENT PROCESS

(71) Applicant: CITIC Dicastal CO., LTD, Hebei (CN)

(72) Inventors: Guohua Liu, Hebei (CN); Xiaopeng Chen, Hebei (CN); Guangcai Chen, Hebei (CN); Le Wang, Hebei (CN); Qun Zhao, Hebei (CN); Chong Li, Hebei (CN); Lei Bao, Hebei (CN)

(73) Assignee: CITIC DICASTAL CO., LTD (CN)

( * ) Notice: Subject to any disclaimer, the term of this patent is extended or adjusted under 35 U.S.C. 154(b) by 0 days.

(21) Appl. No.: 15/673,775

(22) Filed: Aug. 10, 2017

(30) Foreign Application Priority Data

Jun. 22, 2017 (CN) ..... 2017 1 0482437

(51) Int. Cl.

| | |
|---|---|
| ***B05D 1/02*** | (2006.01) |
| ***B05D 3/00*** | (2006.01) |
| ***B05D 3/02*** | (2006.01) |

(52) U.S. Cl.
CPC ..... *B05D 1/02* (2013.01); *B05D 3/002* (2013.01); *B05D 3/0254* (2013.01)

(58) Field of Classification Search
CPC ..... B05D 1/02; B05D 3/002; B05D 3/0254
See application file for complete search history.

(56) References Cited

U.S. PATENT DOCUMENTS

2006/0019089 A1* 1/2006 Leininger ..... B05D 5/10

* cited by examiner

*Primary Examiner* — Xiao S Zhao
(74) *Attorney, Agent, or Firm* — Zheng Liu; Weintraub Tobin

(57) ABSTRACT

Disclosed is an aluminum alloy hub surface treatment process. The specific process flow comprises: providing an aluminum alloy hub blank, sanding, polishing, pre-treating, spraying electroplating silver paint, flash-drying, spraying celluloid paint, curing and discharging. The process not only has the mirror effect of electroplated products, but also has many advantages of simplicity, low cost, no heavy metal pollution and the like.

1 Claim, No Drawings

ALUMINUM ALLOY HUB SURFACE TREATMENT PROCESS

RELATED APPLICATION

This application claims priority to Chinese Patent Application No. 201710482437.7, filed on Jun. 22, 2017, which is hereby incorporated by reference in its entirety.

FIELD OF THE INVENTION

The present invention relates to a coating process, specifically to an aluminum alloy imitated electroplating process.

BACKGROUND OF THE INVENTION

Aluminum alloy electroplated hubs having high brightness and metallic luster are loved by a vast number of car consumers. However, the electroplating process is complex, and the electroplating production process greatly influences the environment. With increasing improvement on environmental protection requirement, a wheel surface treatment process having electroplating silver effect and environment friendliness needs to be developed.

SUMMARY OF THE INVENTION

This patent provides an aluminum wheel surface treatment process having no harm to the environment, high brightness and metallic luster.

An aluminum alloy hub surface treatment process achieves the metal electroplating effect by spraying a layer of 2-5 μm electroplating silver colored paint onto a polished metallic aluminum alloy matrix.

The process of the present invention comprises the procedures of providing an aluminum alloy hub blank, sanding, polishing, pre-treating, spraying electroplating silver, flash-drying, spraying celluloid paint, and curing.

The metallic matrix is sanded by adopting 400#, 800# and 1000# sand paper in sequence to control the positive roughness RA at 0.20-0.23 μm.

A manual polishing machine is matched with polishing paste for polishing to control the roughness RA at 0.16-0.17 μm.

The electroplating silver is sprayed by using air guns, wherein the operation parameters comprise: 14-15" (Din-4), paint throughput 80-150 CC, atomization pressure 2.0-3.5 bar, sector pressure 2.0-3.5 bar, and gun distance 180-250 mm; and the curing condition of the colored paint comprises: keeping the temperature of the workpiece at 150° C. for 10-15 minutes. The electroplating silver product is acrylic series paint.

The celluloid paint is sprayed by using air guns, wherein the operation parameters comprise: operation viscosity 20-21" (Din-4 cup), paint throughput 80-150 CC, atomization pressure 2.5-3.5 bar, sector pressure 2.5-3.5 bar, and gun distance 180-250 mm. The curing condition of the celluloid paint comprises: keeping the temperature of the workpiece at 150° C. for 10-15 minutes. The celluloid paint is acrylic series high-brightness celluloid paint.

Compared with the traditional electroplating process, this process has the advantages that the electroplating procedure having environmental pollute and high cost is replaced with spraying a layer of colored paint, so that the influence on the environment is reduced, the cost is reduced and the production efficiency is improved.

DETAILED DESCRIPTION OF THE EMBODIMENTS

Embodiment 1

An aluminum alloy hub surface treatment process comprises the procedures of providing an aluminum alloy hub blank, sanding, polishing, pre-treating, spraying electroplating silver, flash-drying, spraying celluloid paint, and curing.

The metallic matrix is sanded by adopting 400#, 800# and 1000# sand paper in sequence to guarantee the positive roughness RA at 0.20 μm.

A manual polishing machine is matched with polishing paste for polishing to guarantee the roughness RA at 0.16 μm.

The operation parameters for spraying electroplating silver comprise: 15" (Din-4), paint throughput 100 CC, atomization pressure 3.0 bar, sector pressure 2.5 bar, and gun distance 200 mm; and the flash-drying time is 15 min.

The operation parameters for spraying celluloid paint comprise: operation viscosity 20" (Din-4 cup), paint throughput 150 CC, atomization pressure 2.8 bar, sector pressure 3.0 bar, and gun distance 200 mm.

The curing condition comprises: keeping the temperature of the workpiece at 150° C. for 13 min.

Embodiment 2

An aluminum alloy hub surface treatment process comprises the procedures of providing an aluminum alloy hub blank, sanding, polishing, pre-treating, spraying electroplating silver, flash-drying, spraying celluloid paint, and curing.

The metallic matrix is sanded by adopting 400#, 800# and 1000# sand paper in sequence to guarantee the positive roughness RA at 0.21 μm.

A manual polishing machine is matched with polishing paste for polishing to guarantee the roughness RA at 0.17 μm.

The operation parameters for spraying electroplating silver comprise: 15" (Din-4), paint throughput 90 CC, atomization pressure 2.8 bar, sector pressure 2.5 bar, and gun distance 200 mm; and the flash-drying time is 15 min.

The operation parameters for spraying celluloid paint comprise: operation viscosity 20" (Din-4 cup), paint throughput 150 CC, atomization pressure 2.5 bar, sector pressure 2.8 bar, and gun distance 200 mm.

The curing condition includes: keeping the temperature of the workpiece at 150° C. for 13 min.

Embodiment 3

An aluminum alloy hub surface treatment process comprises the procedures of providing an aluminum alloy hub blank, sanding, polishing, pre-treating, spraying electroplating silver, flash-drying, spraying celluloid paint, and curing.

The metallic matrix is sanded by adopting 400#, 800# and 1000# sand paper in sequence to guarantee the positive roughness RA at 0.21 μm.

A manual polishing machine is matched with polishing paste for polishing to guarantee the roughness RA at 0.16 μm.

The operation parameters for spraying electroplating silver comprise: 15" (Din-4), paint throughput 120 CC, atomization pressure 3.0 bar, sector pressure 3.0 bar, and gun distance 200 mm; and the flash-drying time is 15 min.

The operation parameters for spraying celluloid paint comprise: operation viscosity 20" (Din-4 cup), paint throughput 160 CC, atomization pressure 3.0 bar, sector pressure 3.2 bar, and gun distance 200 mm.

The invention claimed is:

1. An aluminum alloy hub surface treatment process, comprising:

sanding a surface of an aluminum alloy hub using 400-grit, 800-grit, and 1000-grit sand papers sequentially to produce a sanded surface of the aluminum alloy hub, wherein the sanded surface has a roughness between 0.20 μm and 0.23 μm, manually polishing the sanded surface of the aluminum alloy hub to produce a polished surface having a roughness RA between 0.16 μm and 0.17 μm, pre-treating the polished surface of the aluminum alloy hub to produce a pre-treated surface of the aluminum alloy hub, spraying (A), using one or more air guns, silver colored paint onto the pre-treated surface of the aluminum alloy hub, wherein the spraying (A) is done under following conditions: the silver colored paint has a viscosity of 14-15 centistokes as measured by a Din-4 cup, a paint throughput of 80-150 CC, an atomization pressure of 2.0-3.5 bar, a sector pressure of 2.0-3.5 bar, and a gun distance of 180-250 mm, curing the surface of the aluminum alloy hub sprayed with the silver colored paint by keeping temperature of the aluminum alloy hub at 150° C. for 10-15 minutes, flash-drying the surface of the aluminum alloy hub sprayed with the silver colored paint, spraying (B), using one or more air guns, celluloid paint onto the flash-dried surface of the aluminum alloy hub, wherein the spraying (B) is done under following conditions: the celluloid paint has a viscosity of 20-21 centistokes as measured by a Din-4 cup, a paint throughput of 80-150 CC, an atomization pressure of 2.0-3.5 bar, a sector pressure of 2.0-3.5 bar, and a gun distance of 180-250 mm, and curing the celluloid paint sprayed onto the flash-dried surface of the aluminum alloy hub by keeping temperature of the aluminum alloy hub at 150° C. for 10-15 minutes.

* * * * *